US008970473B2

(12) United States Patent
Hsu et al.

(10) Patent No.: US 8,970,473 B2
(45) Date of Patent: Mar. 3, 2015

(54) BISTABLE DISPLAY AND METHOD OF DRIVING A PANEL THEREOF

(75) Inventors: Kuo-Cheng Hsu, Taichung (TW); Kuan-Yi Lien, Tainan (TW); Pei-Yu Chen, Miaoli County (TW); Mei-Sheng Ma, Taipei (TW); Kuo-Hsing Cheng, Hsinchu County (TW)

(73) Assignee: Au Optronics Corporation, Hsinchu (TW)

( * ) Notice: Subject to any disclaimer, the term of this patent is extended or adjusted under 35 U.S.C. 154(b) by 539 days.

(21) Appl. No.: 13/267,895

(22) Filed: Oct. 7, 2011

(65) Prior Publication Data

US 2012/0249508 A1 Oct. 4, 2012

(30) Foreign Application Priority Data

Mar. 30, 2011 (TW) ..... 100111065 A

(51) Int. Cl.
*G09G 3/34* (2006.01)
*G09G 3/20* (2006.01)

(52) U.S. Cl.
CPC ..... *G09G 3/344* (2013.01); *G09G 3/20* (2013.01); *G09G 2300/0452* (2013.01); *G09G 2300/08* (2013.01); *G09G 2310/0254* (2013.01); *G09G 2310/0262* (2013.01)
USPC ..... 345/107

(58) Field of Classification Search
CPC ..... G09G 2320/0285; G09G 3/3651; G09G 3/044; G09G 2300/08; G09G 2300/0804
USPC ..... 345/107, 87
See application file for complete search history.

(56) References Cited

U.S. PATENT DOCUMENTS

| | | | | |
|---|---|---|---|---|
| 7,924,253 | B2 | 4/2011 | Huang et al. | |
| 8,194,104 | B2 | 6/2012 | Suzuki et al. | |
| 2005/0253797 | A1* | 11/2005 | Kamada et al. | 345/89 |
| 2006/0221014 | A1 | 10/2006 | Park et al. | |
| 2008/0165299 | A1 | 7/2008 | Huang et al. | |
| 2010/0103089 | A1* | 4/2010 | Yoshida et al. | 345/102 |
| 2010/0118061 | A1 | 5/2010 | Suzuki et al. | |
| 2010/0289790 | A1 | 11/2010 | Cheng et al. | |
| 2012/0113083 | A1* | 5/2012 | Kim et al. | 345/212 |

FOREIGN PATENT DOCUMENTS

| | | |
|---|---|---|
| CN | 1841478 | 10/2006 |
| CN | 101004502 | 7/2007 |
| CN | 101681601 | 3/2010 |
| TW | 200609865 | 3/2006 |

(Continued)

OTHER PUBLICATIONS

"Office Action of Taiwan Counterpart Application", issued on Oct. 23, 2013, p. 1-p. 8.

(Continued)

*Primary Examiner* — Allison Johnson
(74) *Attorney, Agent, or Firm* — Jianq Chyun IP Office

(57) ABSTRACT

A bistable display and a method of driving a panel thereof are provided. The bistable display includes a bistable display panel and a driving device. The bistable display panel at least has a first pixel and a second pixel, and these two pixels share a data line. The driving device is coupled to the bistable display panel, and used for providing different source driving waveforms to the first pixel and the second pixel respectively.

13 Claims, 9 Drawing Sheets

(56) References Cited

FOREIGN PATENT DOCUMENTS

| | | |
|---|---|---|
| TW | 200830008 | 7/2008 |
| TW | 201040914 | 11/2010 |

OTHER PUBLICATIONS

"Office Action of China Counterpart Application", issued on Dec. 21, 2012, p. 1-p. 5.

* cited by examiner

BISTABLE DISPLAY AND METHOD OF DRIVING A PANEL THEREOF

CROSS-REFERENCE TO RELATED APPLICATION

This application claims the priority benefit of Taiwan application serial no. 100111065, filed on Mar. 30, 2011. The entirety of the above-mentioned patent application is hereby incorporated by reference herein and made a part of specification.

TECHNICAL FIELD

The disclosure relates to a flat panel display technology, more particularly, to a bistable display and a method of driving a panel thereof.

BACKGROUND

A bistable display uses a bistable medium to perform displaying. The techniques for achieving a bistable display includes the techniques of an electronic ink (E-Ink) display, a cholesteric liquid crystal display, (ChLCD), an electrophoretic display (EPD), an elecdtrowetting display (EWD), or a quick response-liquid powder display (QR-LPD), etc. Moreover, with the increasing use of portable electronic devices, products that apply the bistable display technique, such as e-paper and e-book, have gradually captured the attention of the market.

In general, e-papers and the e-books adopt the EPD technique for displaying images. Taking a black-and-white e-book as an example, each of the pixels in the e-book is mainly composed of the black-color electrophoresis buffer and white charged particles doped in the black-color electrophoresis buffer. By providing voltages to the pixels, the white charged particles are driven to shift so that each of the pixels could display black, white, or different gray levels. Taking a colorful e-book for as an example, each of the pixels in the e-book is mainly composed of different micro-cups formed with red-color electrophoresis buffer, green-color electrophoresis buffer, and blue-color electrophoresis buffer, respectively doped with white charged particles. By providing voltages to the pixels, the white charged particles are driven to shift so that each of the pixels could display red, green, blue, or different color levels.

To lower the manufacturing cost of an e-paper or an e-book, a half source driving (HSD) panel structure is proposed as shown in FIG. 1. HSD adopts a switch thin film transistor to allow the data signal received by a same data line to be respectively sent to two pixels in a common pixel at different time points. FIG. 2 is the driving waveform diagram of the panel structure in FIG. 1. Referring to both FIGS. 1 and 2 and as clearly illustrated in FIG. 2, each of the scan lines G1 to G4 respectively receives a scan signal formed with three pulses PLS1 to PLS3. The first pulse PLS1 is used for controlling the operation of the switch thin film transistor (STFT), while the second and the third pulses PLS2 and PLS3 are respectively applied to enable the two pixels Px1 and Px2 in the corresponding common pixel Px (x being a positive integer).

Accordingly, the data signal received by the same data line can be respectively sent to the two pixels Px1 and Px2 in the corresponding common pixel Px during different time points. For example, the data signal received by the data line D1 can be sent to pixel P11 in the common pixel P1 at time (1), while the data signal received by the data line D1 can be sent to pixel P12 in the common pixel P1 at time (2). Further for example, the data signal received by the data line D1 can be sent to the pixel P21 in the common pixel P2 at time (3), while the data signal received by the data line D1 can be sent to pixel P22 in the common pixel p22 t time (4), and so on.

Since the current technique of driving an electrophoresis display with particles mainly adopt a single lookup table mechanism to respectively obtain the driving waveform of each pixel in the electrophoresis display panel with HSD. Additionally, there is a time difference between the second and the third pulses PLS2 and PLS3 in the scan signal respectively received by each of the scan lines G1 to G4, and the display times of the two pixels Px1 and Px2 in the corresponding common pixel Px are thereby different. Hence, if five positions (1) to (5) of the pixel P1 is to be measured (as shown in FIG. 3), based on the results of the measurement shown in FIG. 4, the illumination (whiteness) of pixel P11 is higher than that of pixel P12 under the condition of the same pixel gray level 15. Accordingly, the illumination (whiteness), gamma curve, and contrast of the pixels P11 and P12 are different.

SUMMARY

An exemplary embodiment of the disclosure provides a bistable display and a driving method of a bistable display panel, wherein at least some of the problems confronted by the prior art could be effectively mitigated.

An exemplary embodiment of the disclosures provides a bistable display device, which includes a bistable display panel and a driving device, wherein the bistable display panel includes at least a first pixel and a second pixel, and these two pixels commonly share a data line. The driving device is coupled with the bistable display panel, wherein under a same pixel gray level, the driving device provides different source driving waveforms to the first pixel and the second pixel.

An exemplary embodiment of the disclosure provides a driving method of a bistable display panel, wherein the bistable display panel includes at least a first pixel and a second pixel, and these two pixels commonly share a data line. The driving method includes at least providing different source driving waveforms to the first pixel and the second pixel under a same pixel gray level.

According to an exemplary embodiment of the disclosure, the different source driving waveforms are obtained from two different types of lookup table mechanisms. Further, the two different types of lookup table mechanisms include a first lookup table mechanism and a second lookup table mechanism. The first lookup table mechanism is formed with a first pixel voltage driving waveform and a first common voltage driving waveform of the first pixel, and the second lookup table mechanism is formed with a second pixel voltage driving waveform and the second common voltage driving waveform of the second pixel.

According to an exemplary embodiment of the disclosure, the first pixel is driven by the driving device earlier than the second pixel.

According to an exemplary embodiment of the disclosure, under the condition that the first pixel and the second pixel achieve the same pixel gray level, a time to drive the second pixel by using the second lookup table mechanism during a time period of displaying a frame is greater than a time to drive the first pixel by using the first lookup table mechanism during the time period of displaying the frame (i.e. a frame time period). In this case, the first pixel voltage driving waveform and the second pixel voltage driving waveform may have the same waveform phase, and the first common voltage driving waveform and the second common voltage driving waveform may have the same waveform phase.

According to another exemplary embodiment of the disclosure, under the condition that the first pixel and the second pixel achieve the same pixel gray level, a time to drive the second pixel by using the second lookup table mechanism during a time period of displaying a frame is equal to the time to drive the first pixel by using the first lookup table mechanism during the time period of displaying the frame (i.e. a frame time period). In this case, the first pixel voltage driving waveform and the second pixel voltage driving waveform may have different waveform phases, and the first common voltage driving waveform and the second common voltage driving waveform may have the same waveform phase.

According to another exemplary embodiment of the disclosure, a data signal and a common voltage respectively received by a pixel electrode and a common electrode of the first pixel and the second pixel are an AC form, wherein the data signal is related to the first pixel voltage driving waveform and the second pixel voltage driving waveform, and the common voltage is related to the first common voltage driving waveform and the second common voltage driving waveform.

According to another exemplary embodiment of the disclosure, the data signal and the common voltage respectively received by the pixel electrode and the common electrode of the first pixel and the second pixel are respectively an AC form and a DC form, wherein the data signal is related to the first pixel voltage driving waveform and the second pixel voltage driving waveform, and the common voltage is related to the first common voltage driving waveform and the second common voltage driving waveform.

According to the exemplary embodiments of the disclosure, two different types of lookup table mechanisms are applied to respectively obtain the driving waveform of each pixel in an HSD bistable display panel, which is different from the conventional approach of using a single lookup table mechanism, to compensate the latter driven pixel in the two pixels that commonly share a data line. Hence, when displaying a same pixel gray level, the driving waveforms of the two pixels that commonly share a data line would be different. Accordingly, under the condition of a same pixel gray level, the illumination (regardless it is the whiteness or the blackness), the gamma curve, and the contrast of the two pixels commonly sharing a data line will be more consistent to enhance the display quality of the bistable display device.

The invention and certain merits provided by the invention can be better understood by way of the following exemplary embodiments and the accompanying drawings, which are not to be construed as limiting the scope of the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
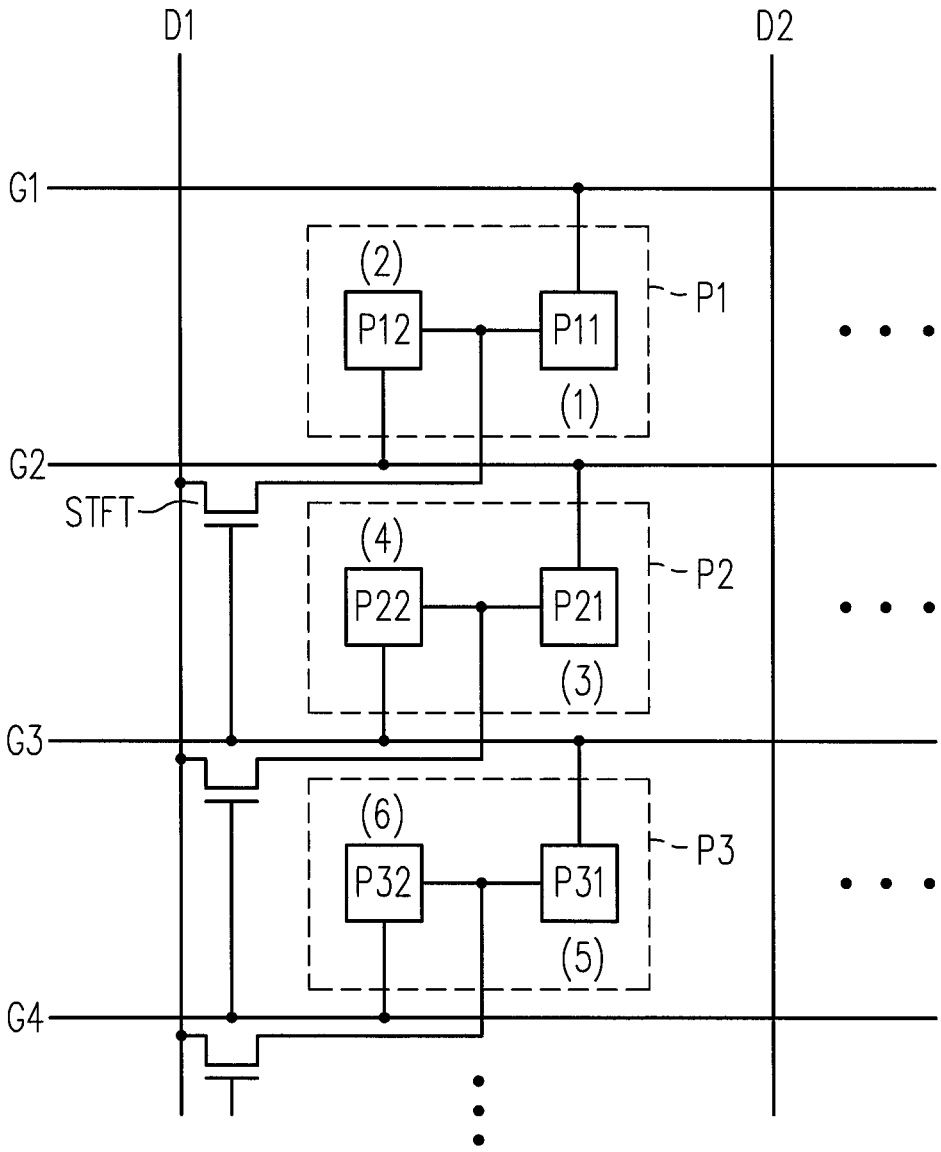
FIG. 1 (RELATED ART)
FIG. 1 is a schematic diagram of a conventional half source driving (HSD) panel structure.

Reference now is made to the accompanying drawings to describe the specific embodiments and examples of the invention. Moreover, the drawings are strictly provided for an illustration purpose, and are not to be construed as limiting the scope of the invention. Wherever possible, the same reference numbers are used in the drawings and the description to refer to the same or like parts.

Figure 5:
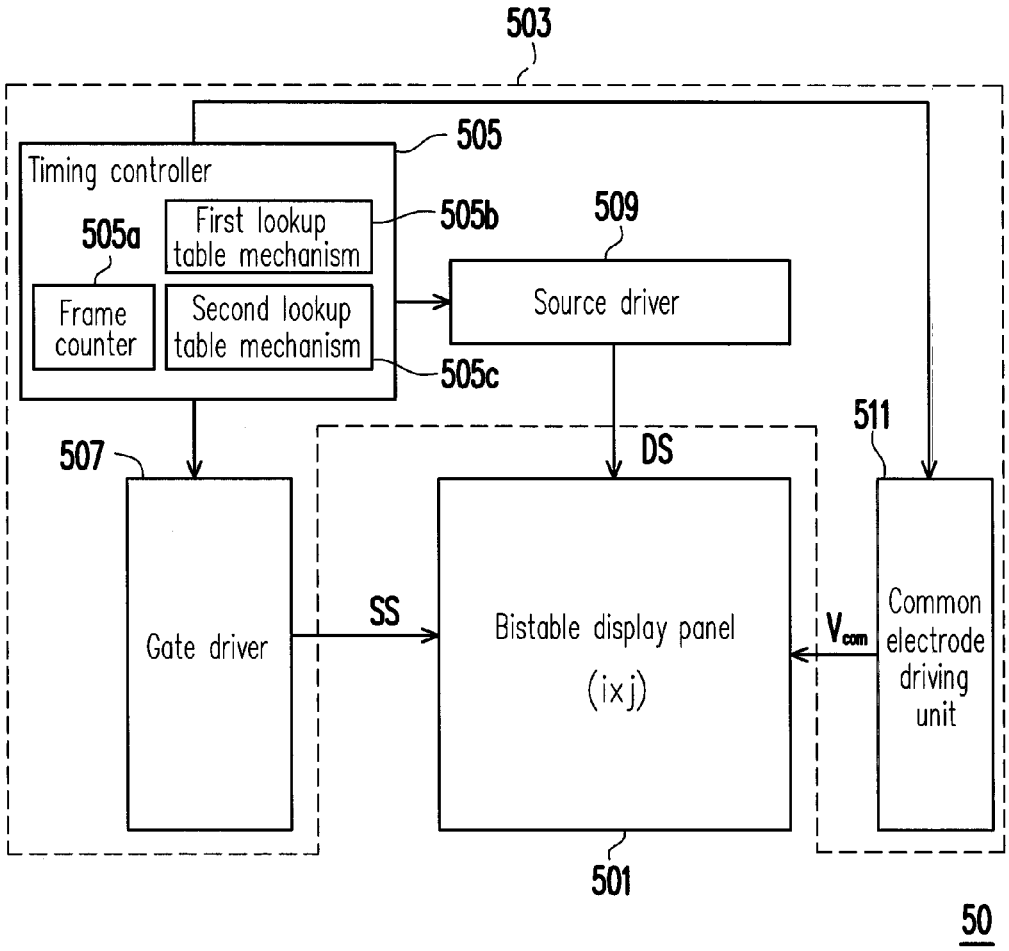
FIG. 5 is a schematic diagram of a bistable display 50 of an exemplary embodiment of the disclosure.

FIG. 5 is a schematic diagram of a bistable display 50 of an exemplary embodiment of the disclosure Referring to FIG. 5, the bistable display 50 includes a bistable display panel 501 and a driving device 503, wherein the bistable display panel may include a half source driving (HSD) panel structure, as shown in FIG. 1. Alternatively speaking, the bistable display panel 501 includes a plurality of common pixels Px (x being a whole number) arranged in an array (i*j, i and j being whole numbers), and each common pixel Px includes two pixels (for example, a first pixel Px1 and a second pixel Px2), wherein the first pixel Px1 and the second pixel Px2 of each common pixel Px commonly share/use a corresponding data line Dx (x being a whole number) through a switch thin film transistor (STFT).

According to an exemplary embodiment of the disclosure, the bistable display panel 50 may be a micro-cup electrophoresis display panel. Obviously, a micro-cup electrophoresis display panel is used as an exemplary example and should not be adopted for limiting the scope of the present invention. The bistable display panel 50 could be other types of bistable display panel, such as a cholesteric liquid crystal display. Since anyone with a general knowledge in this technical area is aware of the structure of a bistable display panel, a detail disclosure thereof will not be reiterated herein.

Moreover, the driving device 503 is coupled to the bistable display panel 501, and the driving device 503, under a same pixel gray level, provides different source driving waveforms to the first pixel Px1 and the second pixel Px2 in each common pixel Px. Further, the different source driving waveforms may be obtained via two different types of lookup table mechanisms, for example, the first lookup table mechanism 505*b* and the second lookup table mechanism 505*c*. More specifically, the driving device 503 may include a timing controller (T-con) 505, a gate driver 507, a source driver 509, and a common electrode driving unit 511. The timing controller 505 may include a frame counter 505*a* and a first lookup table mechanism 505*b* and a second lookup table mechanism 505*c*.

In this exemplary embodiment, the frame counter 505*a* is used in coordinating with the timing controller 505 for realizing the time of each frame of the bistable display 50. Further, the first lookup table mechanism 505*b* and the second look-up table mechanism respectively correspond to a lookup table to be built in a memory at either the interior or the exterior of the timing controller 505. Furthermore, the first lookup table mechanism 505*b* is formed with a first pixel voltage driving waveform and a first common voltage driving waveform of each first pixel Px1, while the second lookup table mechanism 505*c* is formed with a second pixel voltage driving waveform and a second common voltage driving waveform of each second pixel Px2.

On the other hand, the timing controller 505 controls the operations of the gate driver 507, the source driver 509 and the common electrode driving unit 511 so as to drive the first pixel Px1 and the second pixel Px2 in each common-pixel Px in the bistable display panel 501. More particularly, the timing controller 505 controls the gate driver 507 to generate a scan signal (SS) as shown in FIG. 2 in order to control the operation of the switch thin film transistor (STFT) using the pulse PLS1 and to respectively enable the first pixel Px1 and the second pixel Px2 in each common-pixel Px using the pulses PLS2 and PLS3.

Moreover, the timing controller 505 uses the first lookup table mechanism 505*b* and the second lookup table mechanism 505*c* to control the source driver 509 and the common electrode driving unit 511 to respectively generate data signal (DS) and common voltage (Vcom), which are being respectively provided to the pixel electrode (not shown) and the common electrode (not shown) of each first pixel Px1 and each second pixel Px2. Moreover, the data signal and the common voltage Vcom respectively received by the pixel electrode (not shown) and the common electrode (not shown) of each first pixel Px1 and each second pixel Px2 can both be the AC form, or can be respectively the AC form and the DC form; however, the actual design would depend on the practical demands and requirements. Accordingly, the data signal is related to the first and the second pixel voltage driving waveforms, while the common voltage Vcom is related to the first and the second common voltage driving waveforms.

Figure 2:
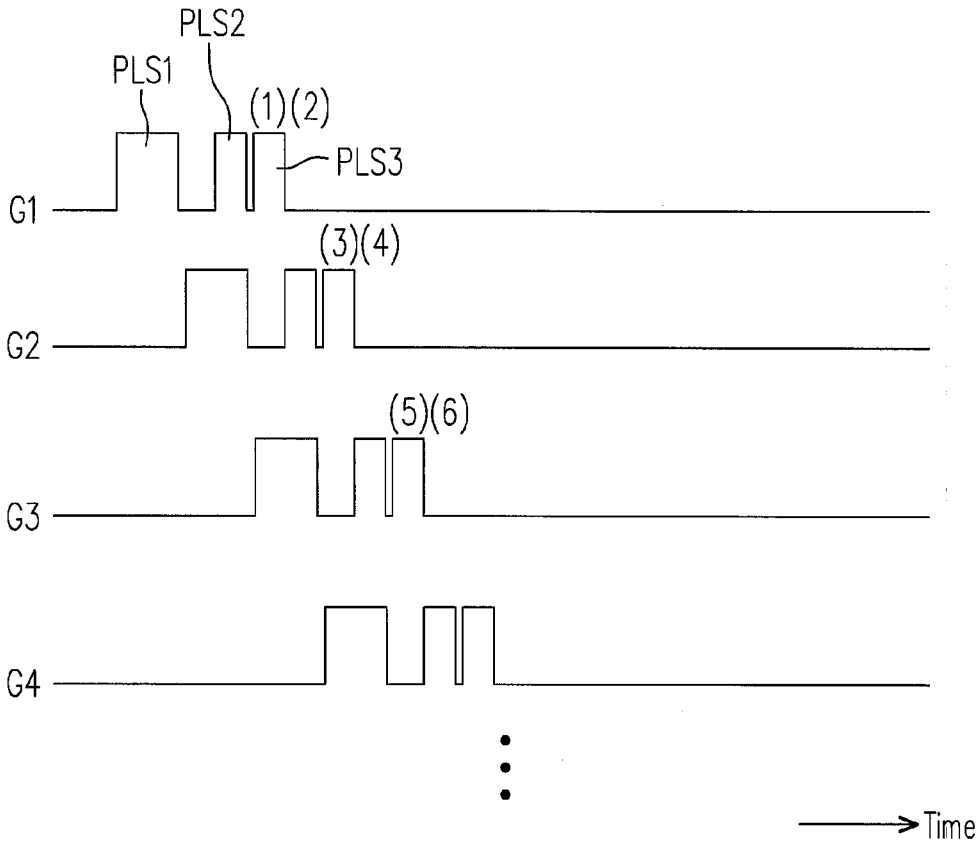
FIG. 2 (RELATED ART)
FIG. 2 is diagram of a driving waveform of the panel structure in FIG. 1.
Figure 3:
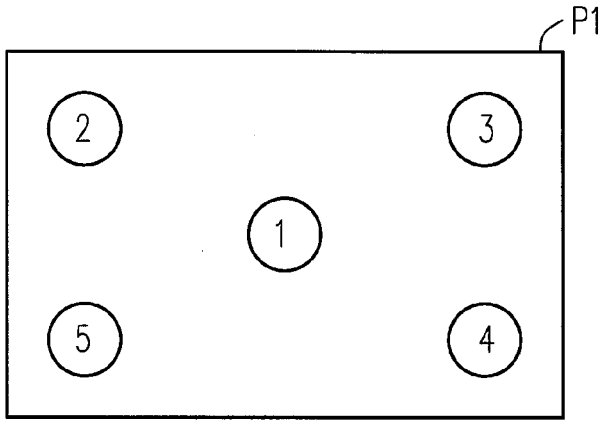
FIG. 3 (RELATED ART)
FIG. 3 is a schematic diagram for measuring the different positions on the pixel P1 in FIG. 1.
Figure 4:
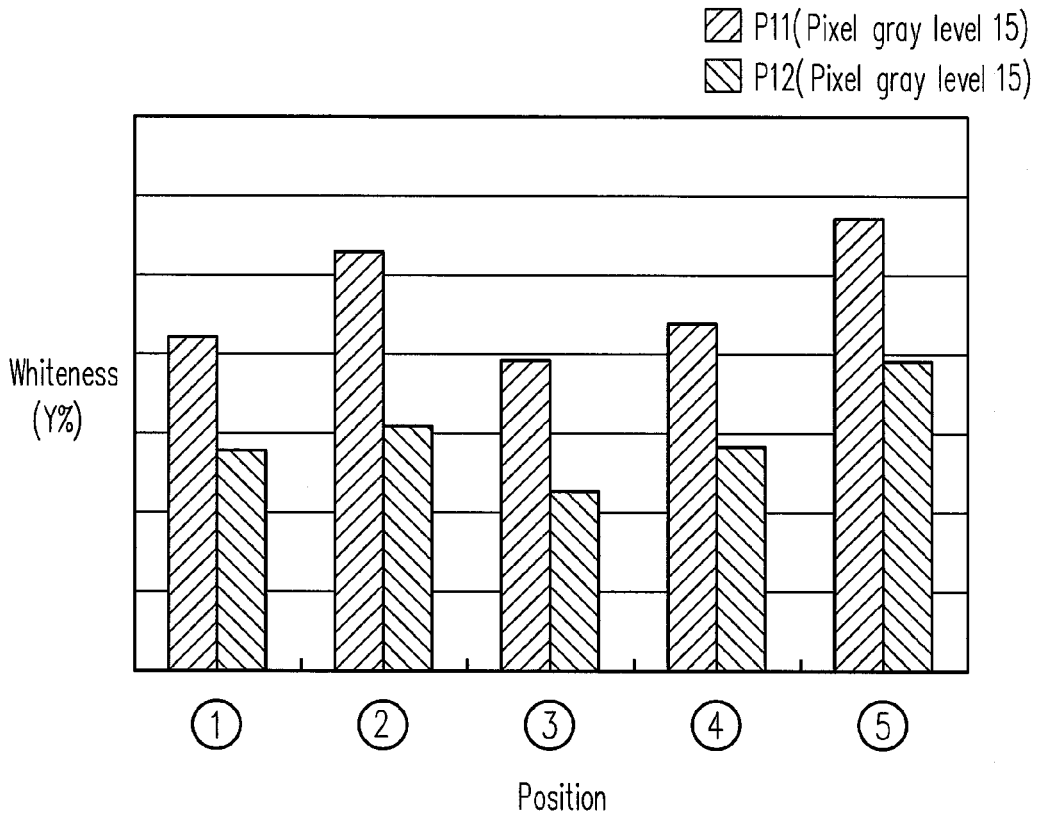
FIG. 4 (RELATED ART)
FIG. 4 is a diagram showing the measurement results of FIG. 3.

According to the present exemplary embodiment, in response to the scan signal SS, as shown in FIG. 2, generated by the gate driver 507, each first pixel Px1 is driven earlier by the driving device 503 than each second pixel Px2. Moreover, under the condition that the two pixels Px1 and Px2 in each common pixel achieve the same pixel gray level, a time for the driving device 503 to drive each second pixel Px2, during a time period for displaying one frame (i.e. a frame time period), by using a second lookup table mechanism 505*c* is greater than a time for the driving device 503 to drive each first pixel Px1, during the time period for displaying one frame (i.e. a frame time period), by using a first lookup table mechanism 505*b*. The so-called "the time period for displaying one frame" may refer to as the driving time/period of the bistable display 50. Accordingly, the timing controller 505 uses a first lookup table mechanism 505*b* to obtain the pixel voltage driving waveform and the common voltage driving waveform of each first pixel Px1 for controlling the source driver 509 and the common electrode driving unit 511 to drive each first pixel Px1. The timing controller 505 also uses the second lookup table mechanism 505*c* to obtain the pixel electrode driving waveform and the common voltage driving waveform of each second pixel Px2 for controlling the source driver and the common electrode driving unit 511 to drive each second pixel Px2.

The data signal and the common voltage Vcom respectively received by each of the pixel electrode and the common electrode of each first pixel Px1 and each second pixel Px2 are assumed to be the AC form. Further, the pixel voltage driving waveform and the common voltage driving waveform of each first pixel Px1 and each second pixel Px2, respectively obtained by the timing controller 505 using the first lookup table mechanism 505*b* and the second lookup table mechanism 505*c*, have four phases, for example, a first phase for executing mechanical balance (which is the normalization of a driving waveform), a second phase and a third phase for executing reset (which is the elimination of a residual image), and a fourth phase of driving pixel (which is the displaying of an image). Each phase includes a plurality of frame times.

Figure 6A:
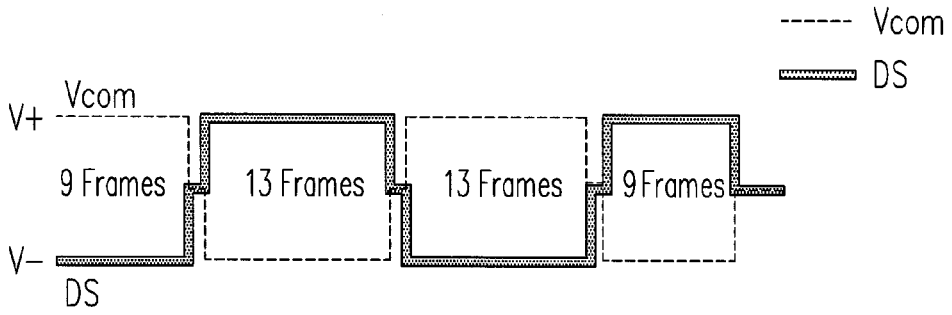
FIG. 6A to FIG. 9D are schematic diagrams of the driving waveform of the common pixel Px in the bistable display panel 501 according to an exemplary embodiment of the disclosure.
Figure 6B:
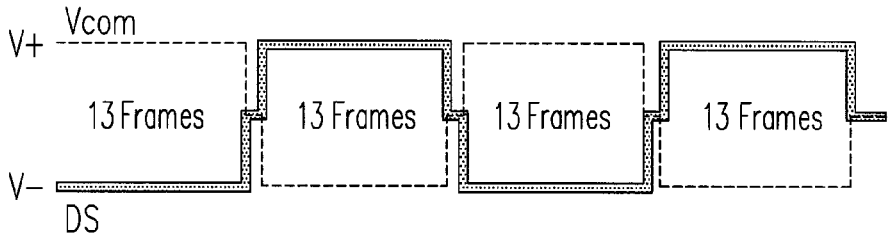

Under the above condition, when the timing controller 505 uses the first lookup table mechanism 505*b* to obtain the pixel voltage driving waveform and the common voltage driving waveform of each first pixel Px1 to display, as shown in FIG. 6A, white gray level (gray 15) (because the level of the common voltage Vcom is negative (V−), while the level of the data signal DS is positive (V+)), and each of the first phase and the fourth phase has, for example, 9 frames (the invention is not limited to 9 frames), wherein the frame times of the first phase and the fourth phase in the voltage driving waveform of the same common pixel could be the same or different, and the second phase and the third phase thereof respectively have, for example, 13 frames (the invention is not limited to 13 frames), the timing controller 505 then uses the second lookup table mechanism 505*c* to obtain the pixel voltage waveform and the common voltage driving waveform, as in FIG. 6B, of each second pixel Px2 obtained by the timing controller 505 to display the white gray level (gray 15), and each of the first to fourth phases has, for example, 13 frame times (the invention is not limited to 13 frames). Apparently, the first pixel voltage waveform and the second pixel voltage waveform have a same waveform phase, and the first common voltage driving waveform and the second common voltage driving waveform have a same waveform phase. Further, the time of the frame (i.e. the fourth phase) displayed by each second pixel Px2 is greater than the time of the frame displayed by each first pixel Px1 to compensate for the whiteness. Apparently, the driving device 503 may provide the different source driving waveforms to each first pixel Px1 and each second pixel Px2, and the corresponding common electrode driving waveforms may also be different. Hence, the whiteness, the gamma curve, and the contrast of each second pixel Px2 are consistent with those of each first pixel Px1.

Figure 6C:
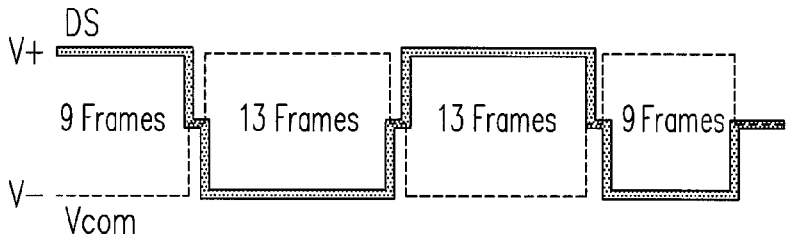
Figure 6D:
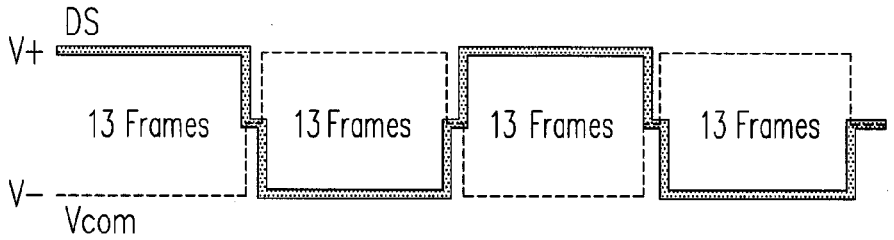

In contrast, when the timing controller 505 uses the first lookup table mechanism 505*b* to obtain the pixel voltage driving waveform and the common voltage driving waveform of each first pixel Px1, as in FIG. 6C, to display the black gray level (gray 0) (since the level of the common voltage Vcom is positive (V+), while the level of the data signal DS is negative (V−)), and the first phase and the fourth phase respectively have, for example, 9 frames (9 frames are provided for an illustration purpose which are not to be construed as limiting the scope of the invention, and the first phase and the fourth phase could have the same or different numbers of phase), and the second phase and the third phase respectively have, for example, 13 frames (13 frames are provided for an illustration purpose which are not to be construed as limiting the scope of the invention), the timing controller 505 uses the second lookup table mechanism 505*c* to obtain the pixel electrode driving waveform and the common electrode driving waveform of each second pixel Px2, as shown in FIG. 6D, to display the black gray level (gray 0). Further, the first phase to the fourth phase respectively include, for example, 13 frames (13 frames are provided for an illustration purpose which are not to be construed as limiting the scope of the invention). It is apparent that the first pixel voltage driving waveform and the second pixel voltage driving waveform have a same waveform phase, and the first common voltage driving waveform and the second common voltage driving waveform also have a same waveform phase. Further, the time of the displayed frame (i.e. the fourth phase) of each second pixel Px2 is still greater than the time of the displayed frame of each first pixel Px1 to compensate for the blackness. Apparently, the driving device 503 provides different source driving waveforms to each first pixel Px1 and each second pixel Px2, and the corresponding common electrode driving waveforms are also different. Accordingly, the blackness, the gamma curve, and the contrast of each second pixel Px2 are consistent with those of each first pixel Px1.

Alternatively, assuming that the data signal and the common voltage Vcom respectively received by the pixel electrode and the common electrode of each first pixel Px1 and each second pixel Px2 are respectively the AC form and the DC form. Further, the pixel voltage driving waveform and the common voltage driving waveform of each first pixel Px1 and each second pixel Px2 respectively obtained by the timing controller 505 by using the first look-up table mechanism 505*b* and the second look-up table mechanism 505*c* include four phases, for example, a first phase for executing mechanical balance (which is the normalization of a driving waveform), a second phase and a third phase for executing reset (which is the elimination of a residual image), and a fourth phase of driving pixel (which is the displaying of an image). Each phase includes a plurality of frame times. The voltage driving waveform in this exemplary embodiment is not limited to four phases. For conserving the driving time, the first phase may be further omitted. Hence, the source driving waveform provided by the data line includes at least three phases.

Figure 7A:
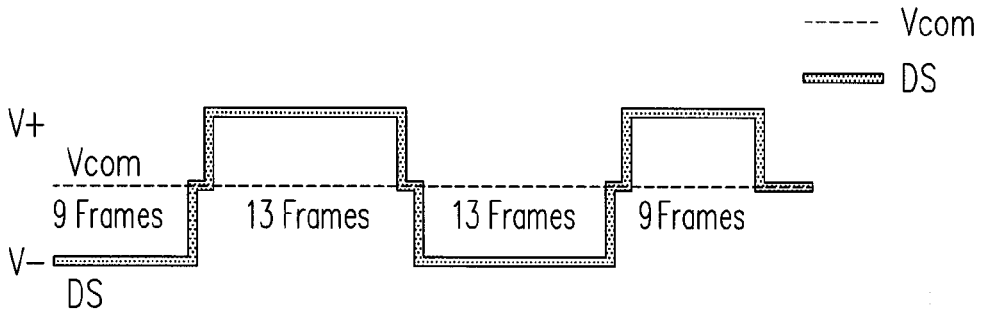
Figure 7B:
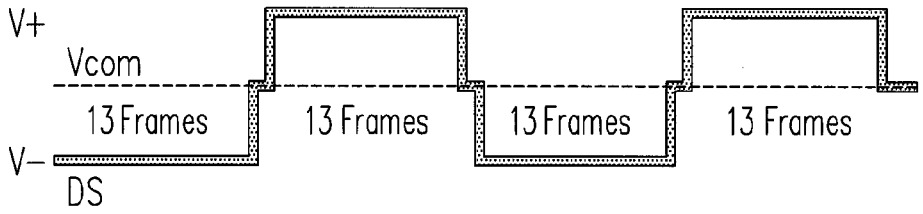

Under such a condition, the timing controller 505 uses a first look-up table mechanism 505*b* to obtain the pixel voltage driving waveform and the common voltage driving voltage form of each first pixel Px1, as shown in FIG. 7A, for displaying a white gray level (gray 15) (since the level of the data signal DS is positive (V+) and higher than the level of the common voltage Vcom), and the first phase and the fourth phase respectively have nine frames (9 frames are provided for an illustration purpose which are not to be construed as limiting the scope of the invention, and the first phase and the fourth phase could have a same or a different number of phases), and the second phase and the third phase respectively have, for example, 13 frames (13 frames are provided for an illustration purpose which are not to be construed as limiting the scope of the invention), the timing controller 505 uses the second lookup table mechanism 505*c* to obtain the pixel electrode driving waveform of each second pixel Px2, as shown in FIG. 7B, for displaying the white gray level (gray 15). Further, the first to the fourth phases respectively include, for example, 13 frames (13 frames are provided for an illustration purpose which are not to be construed as limiting the scope of the invention). It is apparent that the first pixel voltage driving waveform and the second pixel voltage driving waveform have the same waveform phase, and the first common voltage driving waveform and the second common voltage driving waveform have the same waveform phase. Further, the time of the displayed frame of each second pixel Px2 (the fourth phase) is greater than the time of the displayed frame of each first pixel Px1 in order to compensate for the whiteness. Apparently, the driving device 530 provides different source driving waveforms to each first pixel Px1 and each second pixel Px2. Moreover, the corresponding common electrode driving waveforms are also different. Accordingly, the whiteness, the gamma curve, and the contrast of each second pixel Px2 are consistent with those of the first pixel Px1.

Figure 7C:
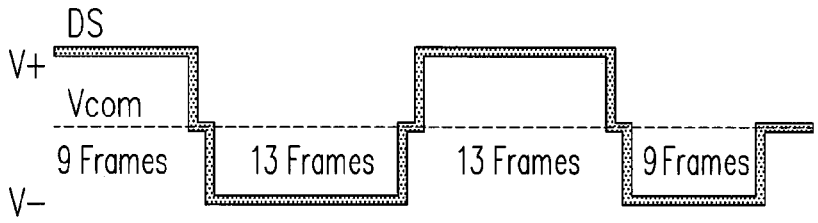
Figure 7D:
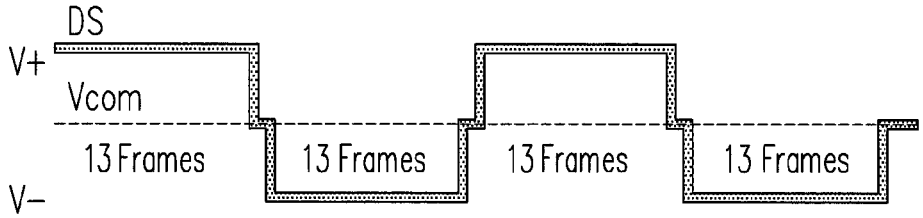

In contrast, when the timing controller 505 uses the first lookup table mechanism 505*b* to obtain the pixel voltage driving waveform and the common voltage driving waveform of each first pixel, as shown in FIG. 7C for displaying the black gray level (gray 0) (since the level of the data signal DS is negative (V−) and is lower than the level of the common voltage Vcom), and the first phase and the fourth phase respectively include nine frames (9 frames are provided for an illustration purpose which are not to be construed as limiting the scope of the invention, and the first phase and the fourth phase could have a same or a different number of phases), while the second phase and the third phase respectively have, for example, 13 frames (the invention is not limited to 13 frames), the timing controller 505 then uses the second lookup table mechanism 505*c* to obtain the driving waveform of each second pixel Px2, as shown in FIG. 7D, for displaying the black gray level (gray 0), and the first phase to the fourth phase respectively have, for example, 13 frames (13 frames are provided for an illustration purpose which are not to be construed as limiting the scope of the invention). Apparently, the first pixel voltage driving waveform and the second pixel voltage driving waveform still have the same waveform phase, and the first common voltage driving waveform and the second common voltage driving waveform have the same waveform phase. Further, the time of the displayed frame of each second pixel Px2 (the fourth phase) is greater than the time of the displayed image of each first pixel (the fourth phase) to compensate for the blackness. Evidently, the driving device 503 provides different source driving waveforms to each first pixel Px1 and each second pixel Px2. Moreover, the corresponding common electrode driving waveforms are also different. Accordingly, the blackness, the gamma curve, and the contrast of each second pixel Px2 are consistent with those of the first pixel Px1.

However, in other exemplary embodiments of the invention, the time for the driving device 503 to drive each second pixel Px2 during the driving time by using the second lookup table mechanism 505*c* may be equal to the time for the driving device 503 to drive each first pixel Px1 by using the first lookup table mechanism 505*b*. In this case, the driving waveform of each first second pixel Px2 driven by the display device 503 during time of displaying one frame by using the second lookup table mechanism 505*c* would be different from the driving waveform of each first pixel Px1 driven by the driving device 503 during the time of displaying one frame by using the first lookup table mechanism 505*b*. In other words, the first pixel voltage driving waveform and the second pixel voltage driving waveform have different waveform phases, while the first common voltage driving waveform and the second voltage driving waveform have the same waveform phase.

Similarly, the timing controller 505 still uses the first lookup table mechanism 505*b* to obtain the pixel voltage driving waveform and the common voltage driving waveform of each first pixel Px1 for controlling the source driver 509 and the common electrode driving unit 511 to drive each first pixel Px1. The timing controller 505 also uses the second lookup table mechanism 505*c* to obtain the pixel voltage driving waveform and the common voltage driving waveform of each second pixel Px2 for controlling the source driver 509 and the common electrode driving unit 511 to drive each second pixel Px2.

Assuming the data signal DS and the common voltage Vcom respectively received by the pixel electrode and the common electrode of each first pixel Px1 and each second pixel Px2 are the AC form. Moreover, the pixel voltage driving waveform and the common voltage driving waveform of each first pixel Px1 and each second pixel Px2, respectively obtained by the timing controller 505 by using the first lookup table mechanism 505*b* and the second lookup table mechanism 505*c*, have four phases, for example, a first phase for executing mechanical balance (which is the normalization of a driving waveform), a second phase and a third phase for executing reset (which is the elimination of a residual image), and a fourth phase of driving pixel (which is the displaying of an image). Each phase includes a plurality of frame times.

Figure 8A:
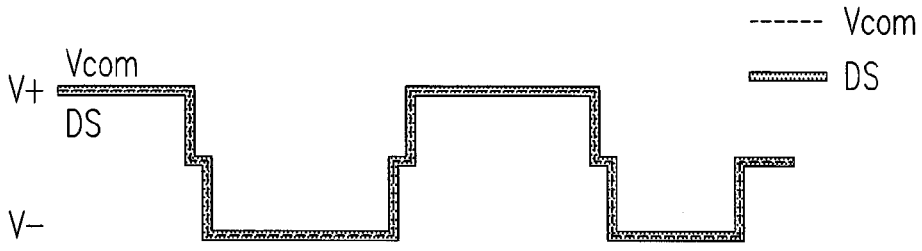
Figure 8B:
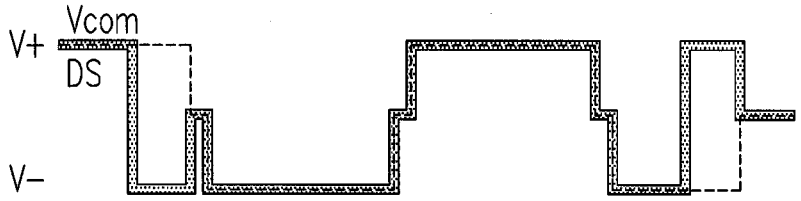

Under such a condition, when the timing controller 505 uses a first lookup table mechanism 505*b* to obtain the pixel voltage driving waveform and the common voltage driving voltage waveform of each first pixel Px1, as in FIG. 8A, from a white gray level to white gray level (gray 15→gray 15, which is a do-nothing), the timing controller uses the second lookup table mechanism 505*c* to obtain the pixel voltage driving waveform and the common voltage driving waveform of each second pixel Px2, as in FIG. 8B, to change the voltage difference between the data signal DS and the common voltage Vcom at the first phase and the fourth phase in order to enhance the driving of the white at the fourth phase. Accordingly, the first pixel voltage driving waveform and the second pixel voltage driving waveform have different waveform phases, and the first common voltage driving waveform and the second common voltage driving waveform have the same waveform phase. Further, although the time of the driving period of each second pixel Px2 is equal to the time of the driving period of each first pixel Px1, the driving waveform of the driving period of each second pixel Px2 is different from the driving waveform of the driving period of each first pixel Px1 to compensate for the whiteness. Apparently, the driving device 503 provides different source driving waveforms to each first pixel Px1 and each second pixel Px2. Moreover, the corresponding common electrode driving waveforms are also different. Accordingly, the whiteness, the gamma curve, and the contrast of each second pixel Px2 are consistent with those of the first pixel Px1.

Figure 8C:
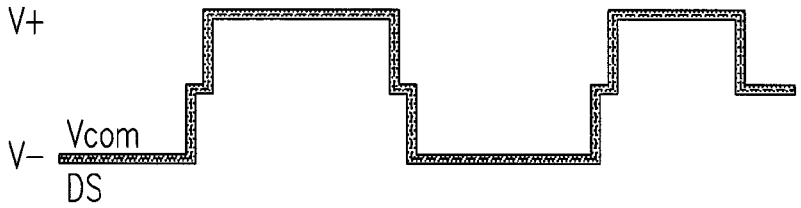
Figure 8D:
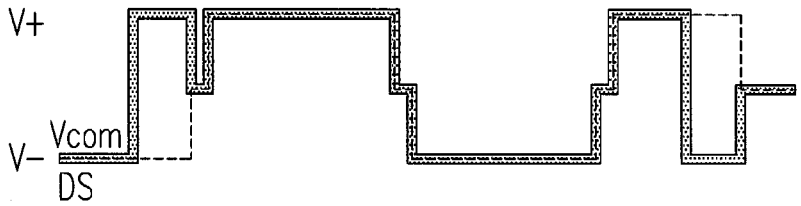

In contrast, when the timing controller 505 uses a first lookup table mechanism 505*b* to obtain the pixel voltage driving waveform and the common voltage driving voltage waveform of each first pixel Px1, as in FIG. 8C, from a black gray level to black gray level (gray 0→gray 0, which is a do-nothing), the timing controller 505 uses the second lookup table mechanism 505*c* to obtain the pixel voltage driving waveform and the common voltage driving waveform of each second pixel Px2, as in FIG. 8D, to change the voltage difference between the data signal DS and the common voltage Vcom at the first phase and the fourth phase in order to enhance the driving of the black at the fourth phase. Accordingly, the first pixel voltage driving waveform and the second pixel voltage driving waveform still have different waveform phases, and the first common voltage driving waveform and the second common voltage driving waveform also have different waveform phases. Further, although the time of the driving period of each second pixel Px2 is equal to the time of the driving period of each first pixel Px1, the driving waveform of the driving period of each second pixel Px2 is different from the driving waveform of the driving period of each first pixel Px1 to compensate for the blackness. Apparently, the driving device 503 provides different source driving waveforms to each first pixel Px1 and each second pixel Px2, and the corresponding common electrode driving waveforms are also different. Accordingly, the blackness, the gamma curve, and the contrast of each second pixel Px2 are consistent with those of the first pixel Px1.

Assuming the data signal D2 and the common voltage Vcom respectively received by the pixel electrode of each first pixel Px1 and each second pixel Px2 are respectively the AC form and the DC form. Moreover, the pixel voltage driving waveform and the common voltage driving waveform of each first pixel Px1 and each second pixel Px2, respectively obtained by the timing controller 505 using the first lookup table mechanism 505*b* and the second lookup table mechanism 505*c*, have four phases, for example, a first phase for executing mechanical balance (which is the normalization of a driving waveform), a second phase and a third phase for executing reset (which is the elimination of a residual image), and a fourth phase of driving pixel (which is the displaying of an image). Each phase includes a plurality of frame times. The voltage driving waveform in this exemplary embodiment is not limited to four phases. To conserve the driving time, the first phase may be further omitted. Hence, the source driving waveform provided by the data line includes at least three phases.

Figure 9A:
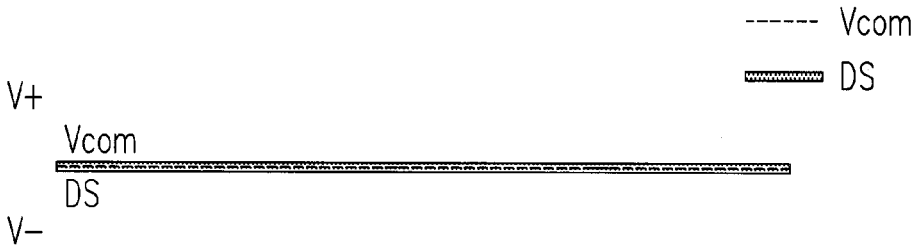
Figure 9B:
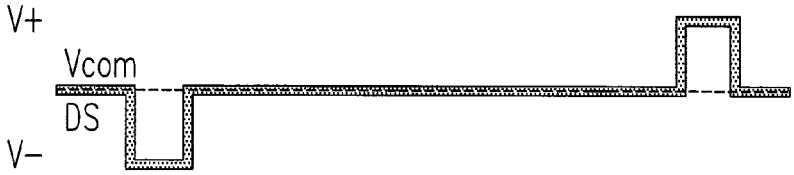

Under such a condition, when the timing controller 505 uses a first lookup table mechanism 505*b* to obtain the pixel voltage driving waveform and the common voltage driving voltage waveform of each first pixel Px1, as in FIG. 9A, from a white gray level to white gray level (gray 15→gray 15, which is a do-nothing), the timing controller 505 uses the second lookup table mechanism 505*c* to obtain the pixel voltage driving waveform and the common voltage driving waveform of each second pixel Px2, as in FIG. 9B, to change the voltage difference between the data signal DS and the common voltage Vcom at the first phase and the fourth phase in order to enhance the driving of the white at the fourth phase. Accordingly, the first pixel voltage driving waveform and the second pixel voltage driving waveform have different waveform phases, and the first common voltage driving waveform and the second common voltage driving waveform have the same waveform phase. Further, although the time of the driving period of each second pixel Px2 is equal to the time of the driving period of each first pixel Px1, the driving waveform of the driving period of each second pixel Px2 is different from the driving waveform of the driving period of each first pixel Px1 to compensate for the whiteness. Apparently, the driving device 503 provides different source driving waveforms to each first pixel Px1 and each second pixel Px2. Accordingly, the whiteness, the gamma curve, and the contrast of each second pixel Px2 are consistent with those of the first pixel Px1.

Figure 9C:
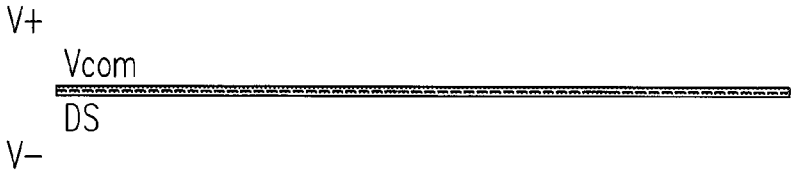
Figure 9D:
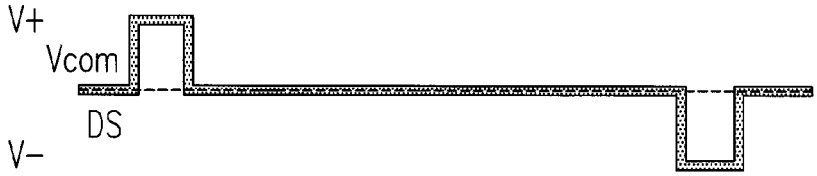

In contrast, when the timing controller 505 uses a first lookup table mechanism 505*b* to obtain the pixel voltage driving waveform and the common voltage driving voltage waveform of each first pixel Px1, as in FIG. 9C, from a black gray level to black gray level (gray 0→gray 0, which is a do-nothing), the timing controller 505 uses the second lookup table mechanism 505*c* to obtain the pixel voltage driving waveform and the common voltage driving waveform of each second pixel Px2, as in FIG. 9D, to change the voltage difference between the data signal DS and the common voltage Vcom at the first phase and the fourth phase in order to enhance the driving of the black at the fourth phase. Accordingly, the first pixel voltage driving waveform and the second pixel voltage driving waveform have different waveform phases, and the first common voltage driving waveform and the second common voltage driving waveform have the same waveform phase. Further, although the time of the driving period of each second pixel Px2 is equal to the time of the driving period of each first pixel Px1, the driving waveform of the driving period of each second pixel Px2 is different from the driving waveform of the driving period of each first pixel Px1 to compensate for the blackness. Apparently, the driving device 503 provides different source driving waveforms to each first pixel Px1 and each second pixel Px2. Accordingly, the blackness, the gamma curve, and the contrast of each second pixel Px2 are consistent with those of the first pixel Px1.

Figure 10:
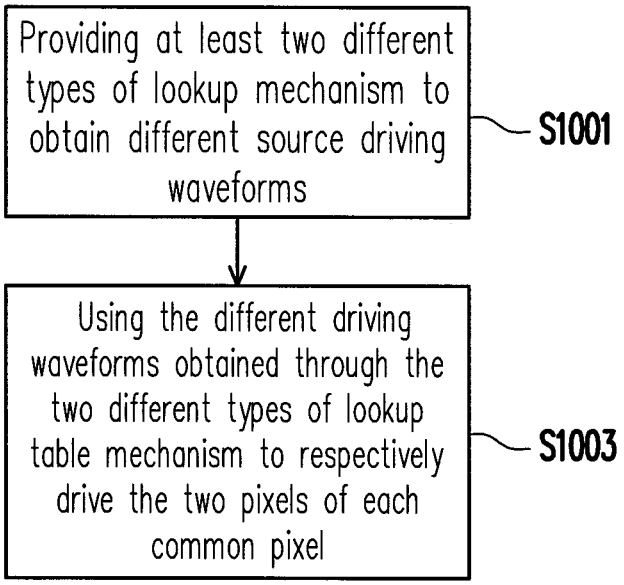
FIG. 10 is a flow chart of steps of the driving method of a bistable display according to an exemplary embodiment of the disclosure.

According to the exemplary embodiments and the above disclosure, FIG. 10 illustrates the process flow of the driving method of a bistable display panel according to an exemplary embodiment of the disclosure. Referring to FIG. 10, the driving method of this exemplary embodiment is suitable for a bistable display panel applying a half source driving (HSD) panel structure. Alternatively speaking, the bistable display panel includes a plurality of common pixels arranged in an array, and each common pixel includes a first pixel and a second pixel. Further, these two pixels commonly share a data line. Accordingly, the driving method of this exemplary embodiment includes providing at least two different types of lookup table mechanisms (step S1001) to obtain different source driving waveforms, and using the different source driving waveforms obtained from these two different types of lookup table mechanisms to respectively drive the two pixels in each common pixel (S1003).

In this exemplary embodiment the two different types of lookup table mechanisms in step S1001 may include a first lookup table mechanism and a second lookup table mechanism, wherein the first lookup table mechanism is formed with the first pixel voltage driving waveform and the first common voltage driving waveform of the first pixel, and the second lookup table mechanism is formed with the second pixel voltage driving waveform and the second common voltage driving waveform of the second pixel. Moreover, each first pixel is driven earlier than each second pixel.

Similarly, under the condition that the first and the second pixels in each common pixel achieve the same pixel gray level, a time to drive each second pixel by using the second lookup table mechanism during a time period of displaying a frame is greater than a time to drive each first pixel by using the first lookup table mechanism during the time period of displaying the frame (i.e. a frame time period). Under such a condition, the first pixel voltage driving waveform and the second pixel voltage driving waveform may have the same waveform phase, and the first common voltage driving waveform and the second common voltage driving waveform may have the same waveform phase.

Alternatively, a time to drive the second pixel by using the second lookup table mechanism during a time period of displaying a frame is equal to a time to drive the first pixel by using the first lookup table mechanism during the time period of displaying the frame (i.e. a frame time period). Further, the first pixel voltage driving waveform and the second pixel voltage driving waveform may have different waveform phases, and the first common voltage driving waveform and the second common voltage driving waveform may have the same waveform phase (in other words, the driving waveform of each second pixel driven by using the second lookup table during the time period for displaying a frame (i.e. a frame time period) could be different from the driving waveform of each first pixel driven by the first lookup table during the time period for displaying a frame (i.e. a frame time period)).

Regardless of which approach is being used to drive each first pixel and each second pixel, under the condition that the first and the second pixel in each common pixel achieve the same pixel level, the whiteness/blackness, the gamma curve, and the contrast of each second pixel are substantially consistent with those of the first pixel. On the other hand, the data signal and the common voltage respectively received by the pixel electrode and the common electrode of each first pixel and each second pixel may be AC form or may be respectively AC form and DC form, depending on the actual design requirements.

According to the exemplary embodiments of the invention, two different types of lookup table mechanisms are applied to respectively obtain the driving waveform of each pixel in an HSD bistable display panel, which is different from the conventional approach of using a single lookup table mechanism, to compensate the latter driven pixel in the two pixels that commonly share a data line. Hence, the driving waveforms of the two pixels that commonly share a data line would be different when displaying a same pixel gray level. Accordingly, under the condition of a same pixel gray level, the illumination (regardless it is whiteness or blackness), the gamma curve, and the contrast of the two pixels commonly sharing a data line will be more consistent to enhance the display quality of the bistable display device. Furthermore, any design, fabrication methods, or any means of applying at least two different types of lookup table mechanisms to respectively drive the pixel in the driving panel (regardless it is for an HSD bistable display panel) fall within the principles of this invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A bistable display comprising:

a bistable display panel, comprising at least a first pixel and a second pixel, the first pixel and the second pixel sharing a data line through a single thin film transistor; and a driving device, coupled with the bistable display panel, wherein the driving device provides different source driving waveforms to the first pixel and the second pixel, wherein the first pixel is driven earlier than the second pixel by the driving device, wherein each source driving waveform has at least three phases: a first phase and a second phase for executing reset, and a third phase for driving the pixel to display an image, wherein each phase includes a plurality of frames, wherein the different source driving waveforms provided to the first and second pixel have the same number of frames in the first and second phases, and the source driving waveform provided to the second pixel has a greater number of frames in the third phase than the number of frames in the third phase of the source driving waveform provided to the first pixel, wherein the first pixel and the second pixel respectively driven by the different source driving waveforms achieve a same pixel gray level, wherein the illumination, gamma curve, and contrast of the second pixel is consistent with the illumination, gamma curve, and contrast of the first pixel.

2. The bistable display of claim 1, wherein the different source driving waveforms are obtained through two different types of lookup table mechanisms.

3. The bistable display of claim 2, wherein the two different types of lookup table mechanisms comprise a first lookup table mechanism and a second lookup table mechanism, and the first lookup table mechanism comprises a first pixel voltage driving waveform and a first common voltage driving waveform of the first pixel, and the second lookup table mechanism comprises a second pixel voltage driving waveform and a second common voltage driving waveform of the second pixel.

4. The bistable display of claim 3, wherein a data signal and a common voltage respectively received by a pixel electrode and a common electrode of the first pixel and the second pixel are an AC form, the data signal is related to the first pixel voltage driving waveform and the second pixel voltage driving waveform, and the common voltage is related to the first common voltage driving waveform and the second common voltage driving waveform.

5. The bistable display of claim 3, wherein a data signal and a common voltage respectively received by a pixel electrode and a common electrode of the first pixel and the second pixel are respectively an AC form and a DC form, the data signal is related to the first pixel voltage driving waveform and the second pixel voltage driving waveform, and the common voltage is related to the first common voltage driving waveform and the second common voltage driving waveform.

6. The bistable display of claim 1, wherein the bistable display panel comprises an electrophoresis display panel (EPD) or a cholesteric liquid crystal display panel (ChLCD).

7. A bistable display comprising:

a bistable display panel, comprising at least a first pixel and a second pixel, the first pixel and the second pixel sharing a data line through a single thin film transistor;

a driving device, coupled with the bistable display panel, wherein the driving device provides different source driving waveforms to the first pixel and the second pixel, wherein the first pixel is driven earlier than the second pixel by the driving device, wherein each source driving waveform has at least three phases: a first phase and a second phase for executing reset, and a third phase for driving the pixel to display an image, and each source driving waveform comprises a pixel voltage driving waveform and a common voltage driving waveform, wherein the duration of each phase of the source driving waveform provided to the first pixel is equal to the duration of each respective phase of the source driving waveform provided to the second pixel, the pixel voltage driving waveform of the first pixel and the pixel voltage driving waveform of the second pixel are different, while the common voltage driving waveforms of the first pixel and second pixel are the same, and wherein the first pixel and the second pixel respectively driven by the different source driving waveforms achieve a same pixel gray level, wherein the illumination, gamma curve, and contrast of the second pixel is consistent with the illumination, gamma curve, and contrast of the first pixel.

8. A driving method of a bistable display panel, wherein the bistable display panel comprises at least a first pixel and a second pixel, and the first pixel and the second pixel share a data line through a single thin film transistor, the method comprising providing different source driving waveforms to the first pixel and the second pixel, wherein the first pixel is driven earlier than the second pixel by the driving device, wherein each source driving waveform has at least three phases: a first phase and a second phase for executing reset, and a third phase for driving the pixel to display an image, wherein each phase includes a plurality of frames, wherein the different source driving waveforms provided to the first and second pixel have the same number of frames in the first and second phases, and the source driving waveform provided to the second pixel has a greater number of frames in the third phase than the number of frames in the third phase of the source driving waveform provided to the first pixel, wherein the first pixel and the second pixel respectively driven by the different source driving waveforms achieve a same pixel gray level, wherein the illumination, gamma curve, and contrast of the second pixel is consistent with the illumination, gamma curve, and contrast of the first pixel.

9. The driving method of claim 8, wherein the different source driving waveforms are obtained through two different types of lookup table mechanisms.

10. The driving method of claim 9, wherein the two different types of lookup table mechanisms comprise a first lookup table mechanism and a second lookup table mechanism, and the first lookup table mechanism comprises a first pixel voltage driving waveform and a first common voltage driving waveform of the first pixel, and the second lookup table mechanism comprises a second pixel voltage driving waveform and a second common voltage driving waveform of the second pixel.

11. The driving method of claim 10, wherein a data signal and a common voltage respectively received by a pixel electrode and a common electrode of the first pixel and the second pixel are an AC form, the data signal is related to the first pixel voltage driving waveform and the second pixel voltage driving waveform, and the common voltage is related to the first common voltage driving waveform and the second common voltage driving waveform.

12. The driving method of claim 10, wherein a data signal and a common voltage respectively received by a pixel electrode and a common electrode of the first pixel and the second pixel are respectively an AC form and a DC form, the data signal is related to the first pixel voltage driving waveform and the second pixel voltage driving waveform, and the common voltage is related to the first common voltage driving waveform and the second common voltage driving waveform.

13. A driving method of a bistable display panel, wherein the bistable display panel comprises at least a first pixel and a second pixel, and the first pixel and the second pixel share a data line through a single thin film transistor, the method comprising providing different source driving waveforms to the first pixel and the second pixel, wherein the first pixel is driven earlier than the second pixel by the driving device, wherein each source driving waveform has at least three phases: a first phase and a second phase for executing reset, and a third phase for driving the pixel to display an image, and each source driving waveform comprises a pixel voltage driving waveform and a common voltage driving waveform, wherein the duration of each phase of the source driving waveform provided to the first pixel is equal to the duration of each respective phase of the source driving waveform provided to the second pixel, the pixel voltage driving waveform of the first pixel and the pixel voltage driving waveform of the second pixel are different, while the common voltage driving waveforms of the first pixel and second pixel are the same, and wherein the first pixel and the second pixel respectively driven by the different source driving waveforms achieve a same pixel gray level, wherein the illumination, gamma curve, and contrast of the second pixel is consistent with the illumination, gamma curve, and contrast of the first pixel.

* * * * *